US008855323B2

(12) United States Patent
Kroman

(10) Patent No.: US 8,855,323 B2
(45) Date of Patent: Oct. 7, 2014

(54) METHOD FOR IDENTIFYING A RECEIVER IN A HEARING AID

(75) Inventor: Morten Kroman, Taastrup (DK)

(73) Assignee: Widex A/S, Lynge (DK)

( * ) Notice: Subject to any disclaimer, the term of this patent is extended or adjusted under 35 U.S.C. 154(b) by 1116 days.

(21) Appl. No.: 12/683,407

(22) Filed: Jan. 6, 2010

(65) Prior Publication Data

US 2010/0111315 A1 May 6, 2010

Related U.S. Application Data

(63) Continuation-in-part of application No. PCT/DK2007/050087, filed on Jul. 10, 2007.

(51) Int. Cl.
*H04R 29/00* (2006.01)
*H04R 25/00* (2006.01)

(52) U.S. Cl.
CPC ..... *H04R 25/305* (2013.01); *H04R 2225/63* (2013.01); *H04R 25/70* (2013.01)
USPC ..... 381/60; 381/312; 381/314; 381/323; 381/330

(58) Field of Classification Search
USPC ..... 381/23.1, 60, 312–331
See application file for complete search history.

(56) References Cited

U.S. PATENT DOCUMENTS

| | | | | |
|---|---|---|---|---|
| 6,651,501 | B1 | 11/2003 | Willis | |
| 7,027,608 | B2 | 4/2006 | Fretz et al. | |
| 7,139,404 | B2 | 11/2006 | Feeley et al. | |
| 7,286,678 | B1 * | 10/2007 | Bachler et al. | 381/314 |
| 7,450,726 | B2 | 11/2008 | Goyal | |
| 7,599,500 | B1 | 10/2009 | Segel et al. | |
| 7,949,144 | B2 * | 5/2011 | Harsch et al. | 381/312 |
| 8,064,609 | B2 * | 11/2011 | Baechler et al. | 381/60 |
| 8,189,829 | B2 * | 5/2012 | Vonlanthen | 381/312 |
| 2001/0053228 | A1 | 12/2001 | Jones | |
| 2003/0002700 | A1 | 1/2003 | Fretz et al. | |
| 2004/0010181 | A1 | 1/2004 | Feeley et al. | |
| 2004/0029313 | A1 | 2/2004 | Hilscher et al. | |
| 2004/0044389 | A1 | 3/2004 | Crawford | |

(Continued)

FOREIGN PATENT DOCUMENTS

| | | | |
|---|---|---|---|
| DE | 102005034380 | B3 | 12/2006 |
| EP | 1517583 | A2 | 3/2005 |

(Continued)

OTHER PUBLICATIONS

Office Action for JP2010513650 dated Dec. 13, 2011 with English translation.

(Continued)

*Primary Examiner* — Matthew Eason
(74) *Attorney, Agent, or Firm* — Sughrue Mion, PLLC

(57) ABSTRACT

A method for identifying a receiver in a hearing aid of the RITE (Receiver In The Ear) type (1) comprises providing a hearing aid of the RITE-type (1), providing said hearing aid with a receiver (10), measuring the impedance of said receiver (10) using said hearing aid (1), identifying said receiver (10) as one of several predetermined receiver models on basis of said impedance measurement, and issuing a message regarding the result of the identification. The invention also provides a hearing aid and a system for fitting a hearing aid. The hearing aid may comprise the means for measuring receiver impedance.

19 Claims, 3 Drawing Sheets

(56) References Cited

U.S. PATENT DOCUMENTS

| | | | | |
|---|---|---|---|---|
| 2004/0247145 | A1 | 12/2004 | Luo et al. | |
| 2005/0190939 | A1 | 9/2005 | Fretz | |
| 2005/0268000 | A1 | 12/2005 | Carlson | |
| 2008/0008340 | A1 | 1/2008 | Bachler et al. | |
| 2008/0279409 | A1* | 11/2008 | Hupkes | 381/370 |

FOREIGN PATENT DOCUMENTS

| | | | |
|---|---|---|---|
| JP | 62151100 | A | 7/1987 |
| JP | 63273072 | A | 11/1988 |
| JP | 11162574 | A | 6/1999 |
| JP | 2001510976 | A | 8/2001 |
| JP | 2001527302 | A | 12/2001 |
| JP | 2005038492 | A | 2/2005 |
| JP | 2005531227 | A | 10/2005 |
| WO | 9904601 | A1 | 1/1999 |
| WO | 9909799 | A2 | 3/1999 |
| WO | W00211509 | A2 | 2/2002 |
| WO | 2004001552 | A2 | 12/2003 |
| WO | 2007045254 | A1 | 4/2007 |

OTHER PUBLICATIONS

Office Action for Japanese Patent Application 2010-513650 dated Apr. 3, 2012.

International Search Report for PCT/DK2007/050087—Mailing Date Apr. 21, 2008.

International Preliminary Report on Patentability—PCT/DK2007/050087—Mailing Date Jun. 15, 2009.

Canadian Office Action for Canadian Application No. 2625024 dated Jul. 10, 2013.

* cited by examiner

METHOD FOR IDENTIFYING A RECEIVER IN A HEARING AID

RELATED APPLICATIONS

The present application is a continuation-in-part of application No. PCT/DK2007050087, filed on Jul. 10, 2007, in Denmark and published as WO 2009006889 A1.

BACKGROUND OF THE INVENTION

1. Field of the Invention

The present invention generally relates to the field of hearing aids. The present invention more specifically relates to a method for identifying a receiver in a hearing aid, to a hearing aid adapted to perform such a method and to a system for fitting a hearing aid.

2. The Prior Art

In the field of hearing aids it is well known to use one or more fitting parameters of a hearing aid, such as e.g. hearing aid gain and parameters regarding acoustic properties, to adapt the hearing aid to the individual hearing needs of a user. For instance it is known from EP-A2-1517583 to estimate the acoustic impedance of a users ear canal by measuring the input impedance of the earpiece of a hearing aid placed in said ear canal, and to use the measured impedance value to fit the hearing aid to the users ear canal.

Furthermore it is known from DE-B3-10 2005 034380 to achieve information about the fit of a hearing aid component placed in the auditory canal of a user by acoustically playing back a measurement signal and receiving the measurement signal influenced by the fit of the hearing aid in the auditory canal. Furthermore it is known to transmit the achieved information to an external device, e.g. a remote control, and to let the external device display a warning message in case of an unsatisfactory fit.

Hearing aids of the RITE (Receiver In The Ear) type generally comprise a Behind-The-Ear (BTE) housing component and a Receiver-In-The-Ear (RITE) component, the RITE component comprising connecting means to connect the BTE housing component to the RITE-component. Furthermore a receiver, i.e. a speaker or acoustic output transducer, is provided in the RITE-component.

Some hearing aids of the RITE-type have been provided with connector systems in order to make the receiver easy to replace as the receiver may simply be disconnected from the RITE-component or the BTE housing component by unplugging a connection means. Hence, there is a possibility of providing different hearing aids with different receivers. The type and fitting parameters of a hearing aid are strongly dependent on the choice of receiver. Therefore the correct combination of type of hearing aid, fitting parameters of the hearing aid and receiver is crucial, as an incorrect combination may result in a significant maladjustment of the hearing aid.

SUMMARY OF THE INVENTION

As RITE-type hearing aids are at the same time getting increasingly common and popular, there is a rising need to enable identification of a receiver when it is connected in the hearing aid to verify a correct combination of receiver, hearing aid type and hearing aid fitting parameters.

The present invention aims at providing a method for simple and time-efficient identification of a receiver in a hearing aid, to enable an operator to take corrective action if necessary.

In a first aspect of the invention, this feature is achieved by providing a method for identifying a receiver in a hearing aid comprising the steps of providing a hearing aid; providing said hearing aid with a receiver; measuring the impedance of said receiver using means in said hearing aid; identifying said receiver as one of several predetermined receiver models on basis of the impedance measurement; and taking an action based on the result of the identification.

Such a method provides a straightforward and time-efficient way of identifying a receiver in a hearing aid, and furthermore provides identification of the subsequent measures to be taken in light of the specific receiver identified.

In a particularly preferred embodiment the method further comprises the step of taking action on said impedance measurement by adjusting the hearing aid or the hearing aid parameters to fit to the specific model of receiver identified, which is convenient, in case adjustment is possible. Thereby it is ensured that the receiver, the hearing aid and the hearing aid fitting parameters are combined correctly where possible, hence ensuring the best possible performance of the hearing aid given the particular circumstances.

In another particularly preferred embodiment the method further comprises the step of taking action on said impedance measurement by replacing the receiver, which is appropriate in case adjustment of the hearing aid to the specific model of receiver identified is not possible. Thereby it is ensured that a combination of receiver, hearing aid and hearing aid fitting parameters that is impossible, illegal or the like can be discovered and the situation corrected as quickly as possible.

This also allows for a defective or otherwise malfunctioning receiver to be replaced prior to performing the measurement.

In a further preferred embodiment of the method the impedance of a receiver is measured using at least one measuring signal frequency. As measuring the impedance of a receiver at one specific measuring signal frequency results in one specific impedance value characteristic for the receiver measured upon, the possibility of measuring at several different measuring signal frequencies opens the possibility of achieving a result comprising several impedance values characteristic for the receiver measured upon. In general one characteristic impedance value is obtained for every measurement signal frequency used.

In a further preferred embodiment of the method the specific model of a receiver is identified by comparing the impedance values measured with predetermined characteristic impedance values for a plurality of receiver types. Performing this step for one or more measured characteristic impedance values enables identification of receiver models having characteristic impedances lying relatively close to each other for certain measuring signal frequencies. However, in most cases it will only be necessary to compare one measured impedance value with the set of predetermined impedance values, as the mutual gaps between characteristic impedance values for the most commonly used receiver models is sufficiently large to safely determine the correct receiver model.

In a further particularly preferred embodiment of the method the impedance measurement and the adjustment of the hearing aid and hearing aid parameters are controlled internally by said hearing aid. This embodiment enables a particularly simple way of performing the method according to the invention, since no external means are needed for the process.

In a further preferred embodiment the method further comprises the step of providing a system for fitting a hearing aid.

In a further preferred embodiment of the method the impedance measurement and the adjustment of the hearing aid and hearing aid parameters is controlled by said system for fitting a hearing aid. Thereby the impedance measurement and the adjustment may be performed as part of a fitting procedure that may have to be performed for other reasons, such as fitting the hearing aid to the ear canal of a user.

According to a second aspect the invention provides a hearing aid of the receiver-in-the-ear type, said hearing aid comprising a behind-the-ear housing component; a receiver-in-the-ear component, said receiver-in-the-ear component including a receiver; means for measuring the impedance of said receiver; means for identifying said receiver as one among several predetermined receivers; and means for taking action based on the result of the identification.

According to a third aspect the invention provides a system for fitting a hearing aid, comprising a computer; hearing aid fitting software installed for execution on said computer; and a hearing aid, said hearing aid comprising means for measuring the impedance of a receiver connected to the hearing aid; means for identifying said receiver as one among several predetermined receivers; and means for communicating the result of the identification to external equipment.

BRIEF DESCRIPTION OF THE DRAWINGS

The invention will now be described in further detail based on a non-limiting exemplary embodiment, and with reference to the drawings. In the drawings.

DETAILED DESCRIPTION OF THE INVENTION

Figure 1:
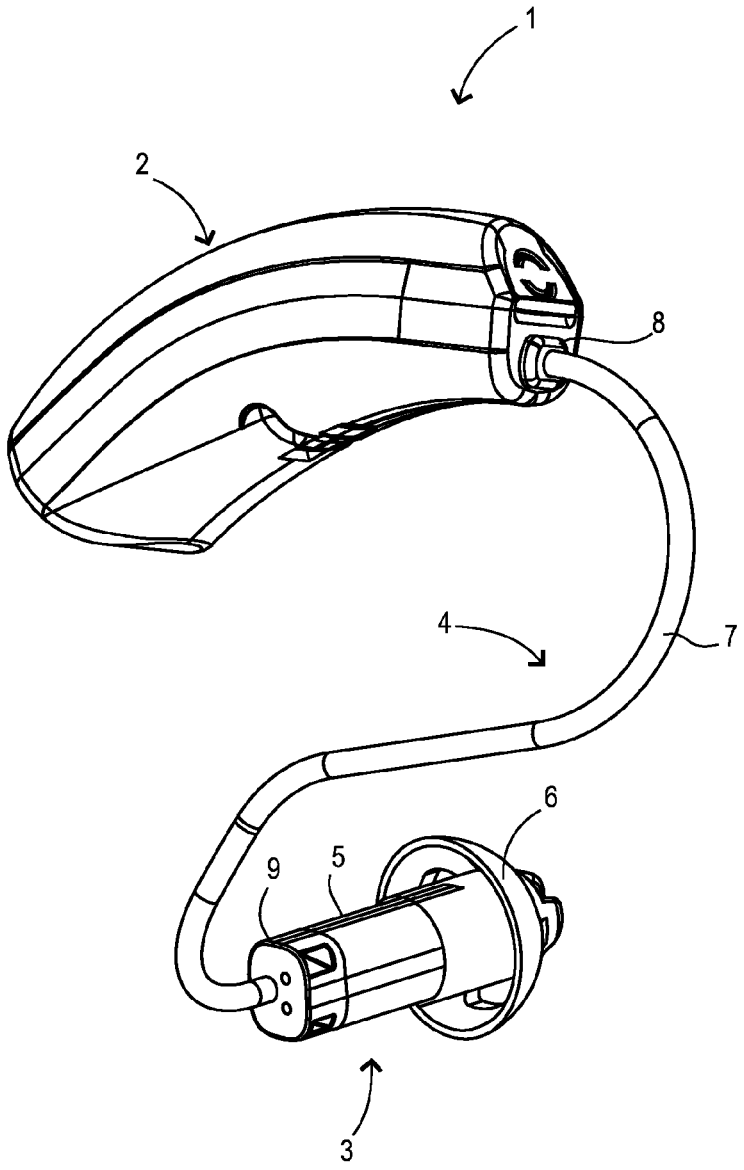
FIG. 1 is a perspective view of a hearing aid of the RITE-type comprising a BTE housing component and a RITE component.

FIG. 1 shows a RITE-type hearing aid 1 as initially described. The hearing aid comprises a Behind-The-Ear (BTE) housing component 2, and a Receiver-In-The-Ear (RITE) component 3. The RITE component comprises a connector 4, a receiver housing 5 and an earplug 6. The connector 4 serves to electrically connect the sound producing parts of the RITE-component 3 with the BTE housing component 2. To enable this the connector 4 comprises an electrically conductive means 7, a coupling means 8 for coupling the RITE component 3 to the BTE housing component 2 and a fixture 9.

Figure 2:
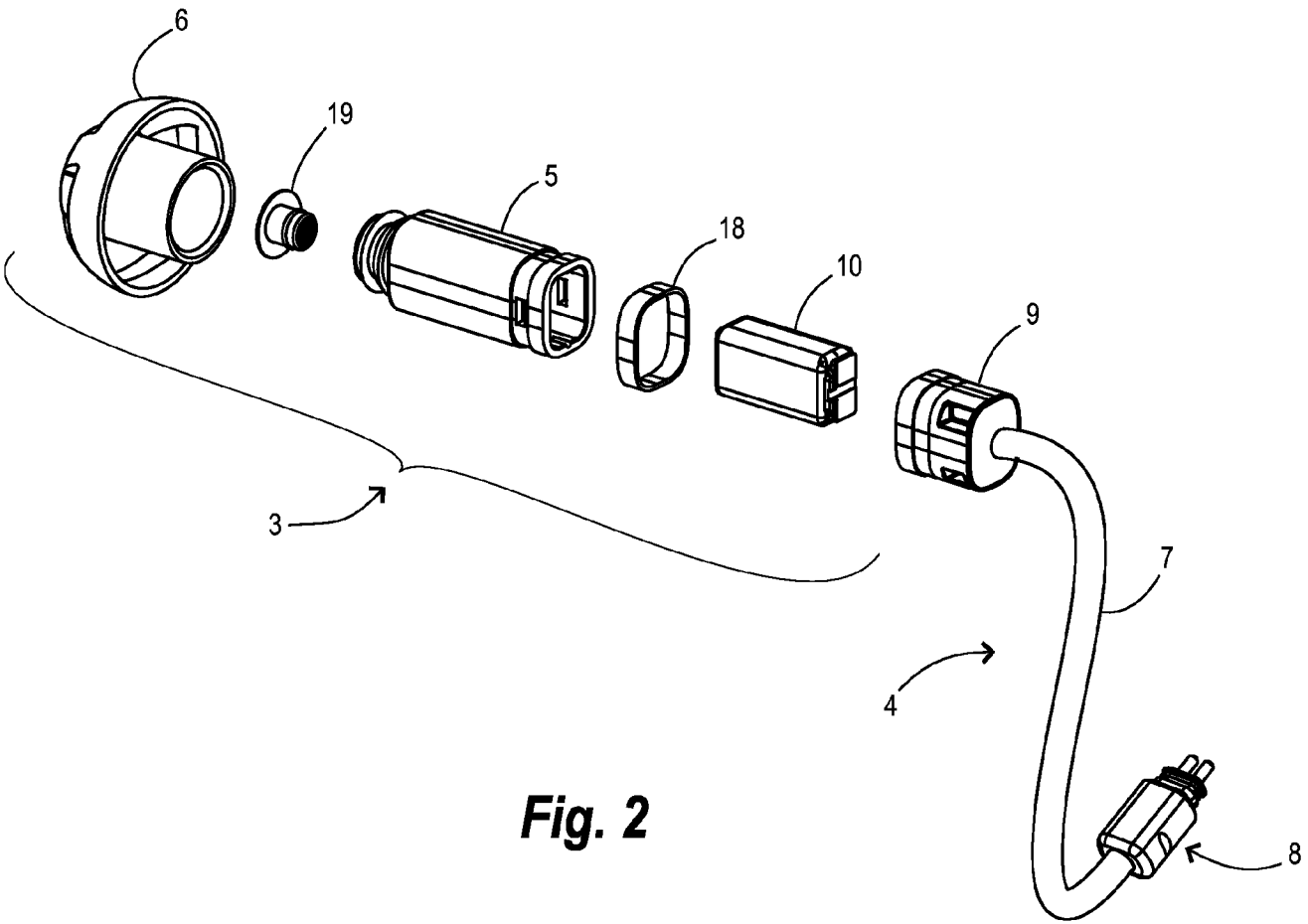
FIG. 2 is an exploded view of a RITE component of a hearing aid of the RITE-type, and FIG. 3 provides a circuit diagram illustrating a preferred embodiment of a hearing aid comprising a circuit capable of performing a method according to the present invention.

As can be seen from FIG. 2 showing an exploded view of a RITE component 3, the RITE component 3 further comprises an earwax guard 19, a receiver housing 5, a receiver sealing 18 and a receiver 10. The fixture 9 is provided to connect the receiver 10 in the receiver housing 5 with the connector 4.

The above mentioned coupling means 8 provides for an easy exchange of the whole RITE component 3 and thereby the receiver 10. Similarly the fixture 9 may in a simple manner be released from the receiver housing 5 enabling easy exchange of the receiver 10. As exchanging the receiver in one of the mentioned ways does not necessarily enable a user or a technician to visually identify the receiver before coupling it to the BTE housing component 2 a need for easy identification of receiver model has arisen.

Further terms used in connection with the description of the current invention will now be defined:

For the purposes of this invention the term "receiver model" means the brand of receiver and the specific model in relation to the specific brand. Examples of brands of receivers are e.g. Sonion and Knowles. Similarly examples of models are e.g. the ED-26871 manufactured by Knowles Electronics, Itasca Ill., or the CI-6697 manufactured by Sonion, Roskilde, Denmark.

The expression "measuring the impedance using said hearing aid" signifies measuring the impedance of a receiver using components inherent in the hearing aid to control and perform the measurement. These components will be the subject of further description below.

For the purposes of this disclosure the term "predetermined characteristic impedance of a receiver" means a previously measured impedance value that is characteristic for a specific receiver model. Such a value is measured for each relevant receiver model using a direct current (DC) as probing signal.

For the purposes of this invention the term "execution unit" means any suitable unit capable of executing executable computer code of a computer program or computer program product.

The present invention makes use of the fact that certain electrical signal processing circuits present in RITE-type hearing aids and adapted to perform acoustical impedance measurements, for instance for the purpose of fitting a hearing aid to the geometry of a user's ear canal as initially described, can be adapted for electrical impedance measurements.

Figure 3:
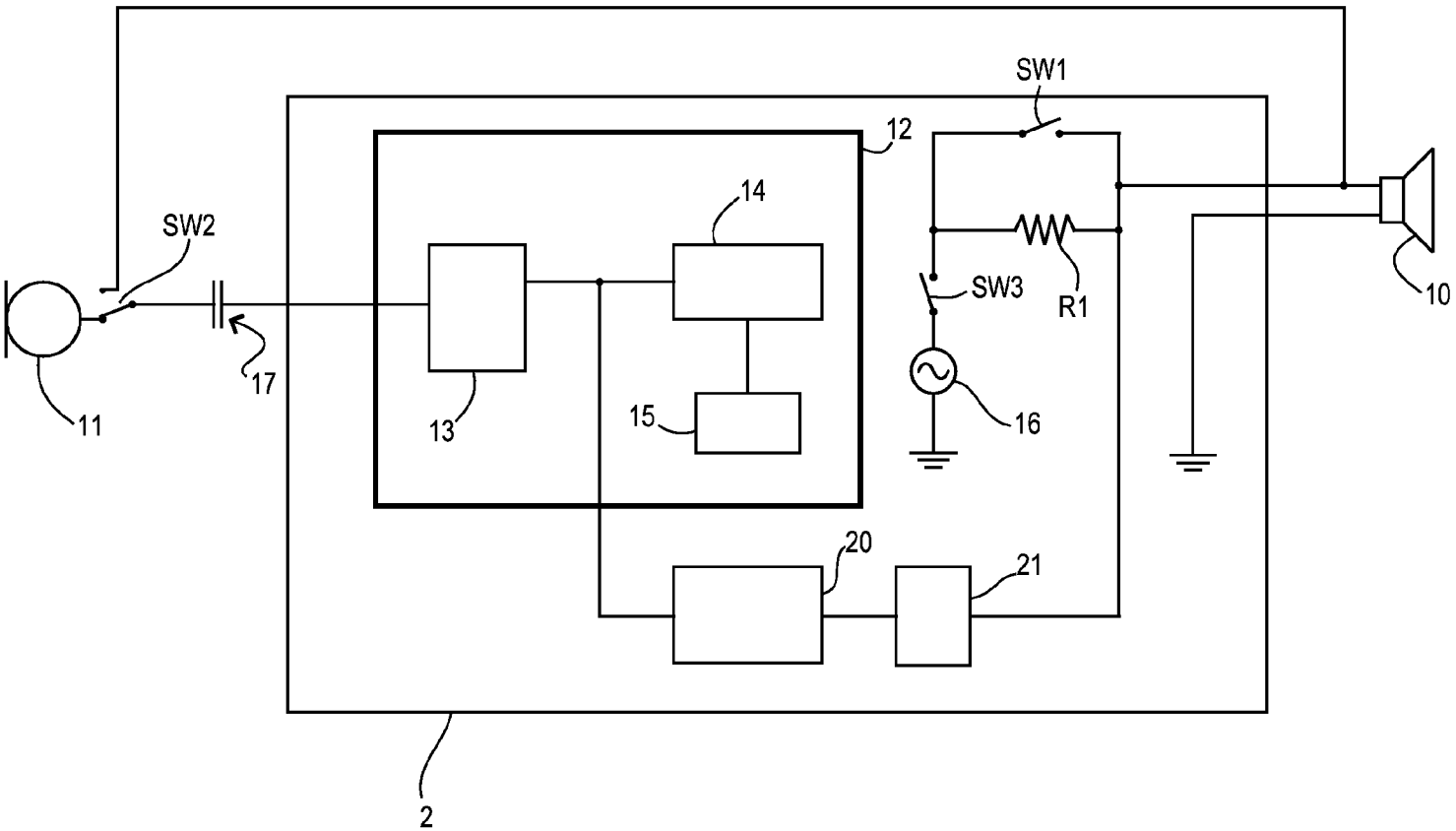

FIG. 3 shows a circuit diagram illustrating an example of such an electrical signal processing circuit inherent in a hearing aid 1. The circuit as shown comprises a measurement unit 12 comprising an A/D (analog/digital) converter 13, a logic unit 14 and a memory unit 15, which measurement unit 12 by use of a switch SW2 may be connected over a capacitor 17 either to a microphone 11 or to the receiver 10. The capacitor 17 may be a polarized capacitor or an electrolyte capacitor. The circuit furthermore comprises an alternating current (AC) signal generator 16, a switch SW3, a switch SW1 and a resistor R1. The AC signal generator 16 may generate a probing signal having one predetermined frequency. By the use of the switch SW1 and the switch SW3 the AC signal from the AC signal generator 16 may be fed either through the resistor R1 by opening the switch SW1 or directly to the receiver 10 by closing the switch SW1. A digital signal processor (DSP) 20 and an output stage or D/A (digital/analog) converter 21 is provided for hearing aid functionality.

Using this circuit the impedance of a receiver 10 may in a preferred embodiment be measured using the A/D converter 13 to measure the receiver load when the AC signal from the AC signal generator 16 is fed through the resistor R1 to the receiver 10 by opening the switch SW1 and when the AC signal is fed directly to the receiver 10 by closing the switch SW1 and subsequently calculate the difference in receiver load. The difference in receiver load found may then be used to calculate the impedance of the receiver 10. The logic unit 14 of the measurement unit 12 may be used to control the switches SW1, SW2 and the AC signal generator 16 during the measurement procedure. The resulting impedance value may be stored in the memory unit 15.

Alternatively is also possible to measure the impedance of a receiver 10 using DC as a measuring signal. In this case the measurement unit 12 may, possibly in place of the A/D converter 13, comprise a unit adapted to measure a DC voltage, for instance a voltmeter.

By repeating the procedure described above one or more times for other measuring signal frequencies it is also possible to measure the impedance of the receiver at several different measuring signal frequencies, thus obtaining one impedance value for each measuring signal frequency used. The significance of this possibility will be addressed later.

It is obvious to a person skilled in the art, that the measurement unit 12 used in the method according to the invention may be any measurement unit suitable for the purpose. For instance in another embodiment of the invention the measurement unit used is the measurement unit of a system for fitting a hearing aid.

Identification of the receiver model according to the invention is performed on basis of the above mentioned impedance measurement. By comparing the impedance value measured with the predetermined characteristic impedance of one or more different receiver models and establishing whether a match is found, the model of the receiver 10 measured upon may be determined. The predetermined characteristic impedances of relevant receiver models may be stored, e.g. in a database, in a memory unit of the measurement unit used for measuring, in the preferred embodiment the memory unit 15 of the measurement unit 12, and the comparison may be performed by an execution unit of the measurement unit, in the preferred embodiment the logic unit 14.

As mentioned initially, the above mentioned identification may be performed with high certainty as there has been shown to be a clear relation between the predetermined characteristic impedance of a receiver and the receiver model when measuring at a given measuring signal frequency. An example of the relation between receiver model and characteristic impedance is shown in table 1 below. The impedance values stated are achieved by an ohmic measurement using a constant DC. It can be seen that the difference between characteristic impedances of different receiver models is sufficiently large to enable identification with a high level of certainty.

TABLE 1

Characteristic impedance of selected receiver models

| BTE component | Receiver model | Characteristic DC Impedance of the Receiver |
|---|---|---|
| A | Sonion CI-6697 | 18 Ohms |
| B | Knowles ED-26871 | 196 Ohms |
| C | Knowles EF-26872 | 105 Ohms |
| D | FC-30045 | 354 Ohms |

Furthermore, as measuring the impedance of a receiver at one specific measuring signal frequency results in one specific impedance value characteristic for the receiver measured upon, the possibility mentioned previously of measuring at several different measuring signal frequencies opens the possibility of achieving a result comprising several impedance values characteristic for the receiver measured upon. Such a result may be used to discern receiver models having characteristic impedance values lying close together at some measuring signal frequencies, but farther apart at other frequencies.

According to an embodiment of the invention, when the receiver model has been identified, information is given by issuing a message such as for instance a warning message. Such a warning message may for instance state whether a potential subsequent adjustment is possible, or it may state that the receiver model identified constitutes an e.g. illegal or disallowed combination with the hearing aid in which it has been inserted. In the embodiment where the hearing aid itself is controlling the impedance measurement, the warning message could for instance be a sound or a sequence of sounds emitted in case the combination of receiver and hearing aid is illegal, disallowed or the like. Of course, any other useful type of warning message may also be used in the method according to the invention.

According to a further embodiment of the method according to the invention action may be taken on said impedance measurement, for instance on basis of the message issued, by replacing the receiver in case the combination of hearing aid and receiver model is deemed illegal, disallowed or the like. In this case the method according to the invention as described above will be performed again to identify the model of the replacement receiver.

According to another further embodiment of the method according to the invention action may be taken on said impedance measurement, for instance on basis of the message issued, by adjusting the hearing aid or the hearing aid parameters to suit the receiver model identified in case adjustment is possible.

By "hearing aid parameters" is herein meant any parameter generally used to fit a hearing aid to the individual hearing needs of a user. As mentioned initially examples of such parameters are hearing aid gain and parameters regarding acoustic properties.

According to a particularly preferred embodiment of the invention the impedance measurement and the adjustment is controlled internally by the RITE-type hearing aid 1 itself. If both the impedance measurement and the adjustment are controlled by the hearing aid itself no external components or devices are needed to carry out these steps of the method according to the invention, making the embodiment particularly simple. In the embodiment described above this is achieved by the measurement unit 12 of the RITE-type hearing aid 1.

Alternatively, in other embodiments of the invention, the impedance measurement and the adjustment may be controlled by an external system, in particular a system for fitting a hearing aid or a computer system. In this case the identification of the receiver model and the adjustment may be performed as part of a fitting procedure. It is, however, obvious to a person skilled in the art that the method according to the present invention may be controlled by any system suitable for the purpose. A suitable system comprises a measurement unit generally comprising an execution unit and a memory unit. In this connection the term "execution unit" means any suitable unit capable of executing executable computer code of a computer program or computer program product according to another aspect of the invention. The system may also comprise other components, such as an A/D converter.

In the preferred embodiment described as an example above the execution unit is the logic unit 14, and the memory unit is the memory unit 15.

In another embodiment, the execution unit may be a computer system carrying out the method according to the present invention. Such a computer system may be applied in a fitting situation in which the hearing aid to be fitted is also connected to the computer system which also comprises executable program code for carrying out a fitting routine. The program code executed on the computer system then includes program portions necessary for carrying out all appropriate steps of the method according to the present invention, including program portions for measuring the impedance of the receiver using at least one measuring signal frequency, identifying the receiver as one of several predetermined receiver models on basis of the impedance measurement, issuing a message, adjusting the hearing aid or the hearing aid parameters to fit to the specific model of receiver identified, and comparing the impedance measured with predetermined characteristic impedance values for a plurality of receiver types.

Methods according to embodiments of the present invention may be implemented in any suitable data processing system like a personal computer or workstation used by, e.g., the audiologist when fitting a hearing aid. Methods according to the present invention may also be implemented in a computer program containing executable program code executing methods according to embodiments described herein. If a client-server-environment is used, an embodiment of the present invention comprises a remote server computer, which embodies a system according to the present invention and hosts the computer program executing methods according to the present invention.

According to another embodiment, the memory unit may be a computer program product like a computer readable storage medium, for example, a floppy disk, a memory stick, a CD-ROM, a DVD, a flash memory, or any other suitable storage medium provided for storing the computer program according to the present invention.

According to a further embodiment, the computer program may be stored in a memory unit of a hearing aid, such as the memory unit 15, or a computer memory and executed by the hearing aid itself or a processing unit like a CPU thereof or by any other suitable processor or a computer executing a method according to the present invention.

All appropriate combinations of features described above are to be considered as belonging to the invention, even if they have not been explicitly described in their combination. Moreover it should be noted that the above description of preferred embodiments is merely an example, and that the skilled person would know that numerous variations are possible without departing from the scope of the claims.

I claim:

1. A method for identifying a receiver component of a hearing aid including a behind-the-ear housing component and a replaceable receiver component for placement in the ear, said method comprising the steps of:

storing predetermined characteristic impedances of a plurality of relevant receiver models in a memory unit of the hearing aid;

storing hearing aid parameters fitting said hearing aid to the individual hearing needs of a user in a memory unit of the hearing aid;

measuring the impedance of said receiver connected to the hearing aid;

identifying said measured receiver as one of said plurality of relevant receiver models by comparing the measured impedance to said stored impedances;

adjusting said hearing aid parameters based on the result of said identification.

2. The method according to claim 1, further comprising the step of issuing a message about the result of the identification.

3. The method according to claim 1, wherein said adjusting step comprises adjusting the hearing aid parameters to fit to the specific model of receiver identified.

4. The method according to claim 1, wherein the impedance of said receiver is measured using at least one measuring signal frequency.

5. The method according to claim 1, wherein the specific model of said receiver is identified by comparing the impedance measured with predetermined characteristic impedance values for said plurality of receiver models.

6. The method according to claim 1, wherein said impedance measurement is controlled internally by said hearing aid.

7. The method according to claim 3, wherein said adjustment is controlled internally by said hearing aid.

8. The method according to claim 1, comprising providing a system for fitting a hearing aid.

9. The method according to claim 8, comprising controlling said impedance measurement by said system for fitting a hearing aid.

10. The method according to claim 3, comprising providing a system for fitting a hearing aid, and controlling said adjustment by said system for fitting a hearing aid.

11. A hearing aid comprising:

a behind-the-ear housing component containing a processor;

a replaceable receiver component for placement in the ear;

wherein said processor is associated with a memory unit which stores predetermined characteristic impedances of a plurality of relevant receiver models; and hearing aid parameters fitting said hearing aid to the individual hearing needs of a user;

wherein said processor is associated with an identification component analyzing the impedance of said receiver and identifying said receiver as one of said plurality of relevant receiver models by comparing the impedances; and wherein said processor adjusts said hearing aid parameters based on the result of the identification.

12. The hearing aid according to claim 11, wherein the hearing aid is adapted for communicating the result of the identification to external equipment.

13. The hearing aid according to claim 11, wherein the impedance of the receiver is measured using at least one measuring signal frequency.

14. The hearing aid according to claim 11, wherein the identification component identifies a plurality of parameters related to the identified receiver.

15. The hearing aid according to claim 14, wherein the processor adjusts a plurality of parameters related to the identified receiver.

16. The hearing aid according to claim 12, wherein the external equipment comprises a computer running fitting software adapted to provide fitting advice based on the result of the identification.

17. A system for fitting a hearing aid, comprising a computer operated by a fitting session operator;

hearing aid fitting software installed for execution on said computer; and a said hearing aid comprising:

a behind-the-ear housing component containing a processor;

a replaceable receiver component for placement in the ear;

wherein said processor is associated with a memory unit which stores predetermined characteristic impedances of a plurality of relevant receiver models;

hearing aid parameters fitting said hearing aid to the individual hearing needs of a user;

wherein said processor is associated with a component analyzing the impedance of said receiver component and identifying said receiver component as one of said plurality of relevant receiver models by comparing the impedances; and wherein said processor communicates the result of the identification of the receiver component to said computer, and the fitting session operator is notified about the result of the identification of said receiver component via said fitting software installed for execution on said computer.

18. The system according to claim 17, wherein the fitting software installed on the computer comprises means for displaying information regarding the impedance of the receiver connected to the hearing aid.

19. A method for during a fitting session identifying a receiver component of a hearing aid including a behind-the-ear housing component and a replaceable receiver component for placement in the ear, said method comprising the steps of:

connecting a computer having hearing aid fitting software installed to said hearing aid;

storing predetermined characteristic impedances of a plurality of relevant receiver models in a memory unit of the hearing aid;

storing hearing aid parameters fitting said hearing aid to the individual hearing needs of a user in a memory unit of the hearing aid;

measuring the impedance of said receiver connected to the hearing aid;

identifying said measured receiver as one of said plurality of relevant receiver models by comparing the measured impedance to said stored impedances;

communicating the result of the identification of the receiver component to said computer; and notifying a fitting session operator about the result of the identification of said receiver component via said fitting software installed on said computer.

* * * * *